US010726810B2

(12) United States Patent
Lee et al.

(10) Patent No.: US 10,726,810 B2
(45) Date of Patent: Jul. 28, 2020

(54) DISPLAY DEVICE AND METHOD OF DISPLAYING IMAGE BY USING DISPLAY DEVICE

(71) Applicant: SAMSUNG DISPLAY CO., LTD., Yongin-si, Gyeonggi-do (KR)

(72) Inventors: Kang Hee Lee, Yongin-si, Gyeonggi-do (KR); Seung Ho Park, Yongin-si, Gyeonggi-do (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 7 days.

(21) Appl. No.: 15/618,860

(22) Filed: Jun. 9, 2017

(65) Prior Publication Data

US 2018/0012563 A1 Jan. 11, 2018

(30) Foreign Application Priority Data

Jul. 8, 2016 (KR) ..... 10-2016-0087061

(51) Int. Cl.

| | |
|---|---|
| ***G09G 5/10*** | (2006.01) |
| ***G09G 3/20*** | (2006.01) |
| *G09G 3/00* | (2006.01) |
| *G09G 3/3208* | (2016.01) |
| *G09G 3/28* | (2013.01) |
| *G09G 3/36* | (2006.01) |

(52) U.S. Cl.

CPC ..... *G09G 5/10* (2013.01); *G09G 3/20* (2013.01); *G09G 3/007* (2013.01); *G09G 3/28* (2013.01); *G09G 3/3208* (2013.01); *G09G 3/3611* (2013.01); *G09G 2310/08* (2013.01); *G09G 2320/029* (2013.01); *G09G 2320/0257* (2013.01); *G09G 2320/048* (2013.01); *G09G 2320/0626* (2013.01); *G09G 2340/0464* (2013.01); *G09G 2360/16* (2013.01)

(58) Field of Classification Search

None

See application file for complete search history.

(56) References Cited

U.S. PATENT DOCUMENTS

| | | | | |
|---|---|---|---|---|
| 8,610,704 | B2 | 12/2013 | Yun et al. | |
| 2005/0093850 | A1* | 5/2005 | Mori | G09G 3/007 345/204 |
| 2006/0001601 | A1* | 1/2006 | Ono | G09G 3/007 345/60 |
| 2007/0146485 | A1* | 6/2007 | Horikoshi | G09G 3/007 348/173 |

(Continued)

FOREIGN PATENT DOCUMENTS

| | | |
|---|---|---|
| JP | 2000-231364 | 8/2000 |
| KR | 10-2005-0105574 | 11/2005 |

*Primary Examiner* — Aaron M Richer

(74) *Attorney, Agent, or Firm* — F. Chau & Associates, LLC

(57) ABSTRACT

A method of displaying an image by using a display device. The method includes: grouping pixels included in a display unit into pixel blocks, generating a first accumulated stress map representing a degree of a deteriorated performance of the pixels included in the pixel blocks based on first image data of a current frame image, and determining a shiftable range of the current frame image by analyzing the first accumulated stress map. The first image data is corrected to second image data in which the current frame image is shifted within the shiftable range.

20 Claims, 12 Drawing Sheets

(56) References Cited

U.S. PATENT DOCUMENTS

| | | | | |
|---|---|---|---|---|
| 2007/0236410 | A1* | 10/2007 | Shimizu | G09G 3/20<br>345/20 |
| 2008/0150971 | A1* | 6/2008 | Kienhoefer | G09G 3/22<br>345/690 |
| 2011/0227961 | A1* | 9/2011 | Kikuta | G09G 3/3225<br>345/690 |

* cited by examiner

DISPLAY DEVICE AND METHOD OF DISPLAYING IMAGE BY USING DISPLAY DEVICE

CROSS-REFERENCE TO RELATED APPLICATIONS

This application claims priority to and the benefit of Korean Patent Application No. 10-2016-0087061, filed on Jul. 8, 2016, in the Korean Intellectual Property Office, the entire contents of which are incorporated by reference herein.

1. TECHNICAL FIELD

The inventive concept relates to a display device, and a method of displaying an image by using the same.

2. DISCUSSION OF THE RELATED ART

Various kinds of display devices, such as an organic light emitting display device, a liquid crystal display device, and a plasma display device, are now in widespread use.

When a display device outputs specific images or characters for a long time, a specific pixel may become degraded, thereafter generating an afterimage. In the case of LCDs, this phenomenon may be referred to as "image persistence".

To prevent or reduce afterimages, a pixel shift technology has been developed. In pixel shift technology, the display of an image on a display panel may be moved (e.g. shifted) after a predetermined period of time. When the display device shifts an image at a predetermined period and displays the shifted image on a display panel, the same data is prevented from being output in a specific pixel for a long time, that may prevent a specific pixel from being degraded.

For example, the display device may shift an image with the same pattern by the pixel shift technology. However, when the display device shifts the image by repeating the same pattern, a region of a pixel, in which the image is movable, is limited, that may degrade the performance of the display device.

SUMMARY

The present inventive concept provides a display device, which may prevents a pixel from being degraded and the generation of an afterimage by shifting an image by a pixel shift operation, and a method of displaying an image by using the same.

An exemplary embodiment of the present inventive concept provides a method of displaying an image by using a display device, in which the method may include grouping a plurality of pixels included in a display panel of a display device into respective pixel blocks, generating a first accumulated stress map representing a degree of a deteriorated performance of the pixels in the respective pixel blocks based on a first image data of a current frame image, determining a shiftable range of display of the current frame image based on a content of the first accumulated stress map; and correcting the first image data to a second image data in which a display of the current frame image by the display panel is shifted within the shiftable range.

According to an embodiment of the inventive concept, the generating of the first accumulated stress map may include calculating an average brightness value of each of the pixel blocks, generating a stress map of the current frame image including the average brightness value, reading a second accumulated stress map of a previous frame image from a memory, and generating the first accumulated stress map by applying the stress map to the second accumulated stress map.

According to an embodiment of the inventive concept the determining of the shiftable range may include calculating a brightness difference between adjacently disposed pixel blocks by analyzing the first accumulated stress map, comparing the brightness difference and a reference brightness difference, and determining the shiftable range in accordance with a compared result.

According to an embodiment of the inventive concept, the determining of the shiftable range may include calculating a first brightness difference between adjacent rows among the pixel blocks, calculating a second brightness difference between adjacent columns among the pixel blocks, determining the shiftable range as a first shiftable range when any one of the first brightness difference and the second brightness difference is larger than a reference brightness difference, and determining the shiftable range as a second shiftable range when the first brightness difference and the second brightness difference are smaller than the reference brightness difference, and the first shiftable range may include a broader range than the second shiftable range.

Another exemplary embodiment of the present inventive concept provides a method of displaying an image by using a display device, the method including: grouping pixels included in a display panel of the display device into respective pixel blocks, generating a first accumulated stress map representing a degree of a deteriorated performance of the pixels in the respective pixel blocks based on a first image data of a current frame image, generating an expected accumulated stress map, in which the degree of the deteriorated performance of the pixels according to a shift of a display of the current frame image by the display device is expected, based on the first accumulated stress map, determining a shiftable display route, in which the degree of the deteriorated performance of the pixels is smallest, based on a content of the expected accumulated stress map, and correcting the first image data to second image data in which display of the current frame image is shifted in accordance with the shiftable display route.

The generating of the accumulated stress map may include calculating an average brightness value of each of the pixel blocks, generating a stress map of the current frame image including the average brightness value, reading a second accumulated stress map of a previous frame image from a memory, and generating the first accumulated stress map by applying the stress map of the current frame image to the second accumulated stress map of the previous frame image.

The generating of the expected accumulated stress map may include calculating a shift stress map of a shifted frame image generated by shifting the current frame image by a predetermined amount in an x-axis direction or a y-axis direction within the display unit, and generating the expected accumulated stress map by applying the shift stress map to the first accumulated stress map.

The generating of the expected accumulated stress map may include calculating shift stress maps of shifted frame images generated by shifting the current frame image by a predetermined amount along all of shiftable routes within the display unit, and generating the expected accumulated stress maps by applying each of the shift stress maps to the first accumulated stress map.

The determining of the shift route may include determining a minimum stress map, in which the degree of a deteriorated performance of the pixels is smallest, among the expected accumulated stress maps, and determining a first shift route for the minimum stress map as the shift route.

The generating of the expected accumulated stress map may include calculating shift stress maps of shifted frame images generated by shifting the current frame image along a plurality of predetermined reference routes within the display unit, and generating reference accumulated stress maps by applying each of the shift stress maps to the first accumulated stress map, and determining a minimum stress map, in which the degree of a deteriorated performance of the pixels is smallest, among the reference accumulated stress maps as the expected accumulated stress map.

Yet another exemplary embodiment of the present inventive concept provides a display device, including: a processor configured to generate a stress map representing the degree of a deteriorated performance of pixels by using a brightness distribution of a current frame image, and generating image data, which shifts display of the current frame image so that stress is dispersed, based on the stress map; and a display panel including the pixels and configured to display an image by using the image data.

The processor may include: an image data generator, which generates first image data of the current frame image; a stress calculator, which analyzes a brightness distribution of the current frame image based on the first image data, and generates the stress map; a shift range determiner, which analyzes the stress map and determines a shiftable range and a shift route of the current frame image; and an image corrector, which corrects the first image data to second image data so that the current frame image is shifted in accordance with the shiftable range and the shift route.

The stress map generator may group the pixels into pixel blocks, calculate an average brightness value of the pixel blocks, and calculate the brightness distribution of the current frame image.

The display device may further include a memory configured to store a second accumulated stress map of a previous frame image.

The stress map generator may generate a first accumulated stress map of the current frame image by applying the stress map to the second accumulated stress map read from the memory.

According to the display device and the method of displaying an image according to the present inventive concept, to the pixels may be prevented from deteriorating by shifting an image by a pixel shift operation to reduce or prevent the generation of an afterimage.

Further, according to the display device and the method of displaying an image according to the present inventive concept, there may be an expected accumulated stress of pixels according to a shift of an image, and a shift of the image along an optimum route, in which the a deteriorated performance of the pixels is minimized.

In an embodiment of the inventive concept, a display device may include at least one processor configured to generate a first image data, a memory connected to the at least one processor that stores an accumulated stress map, a display panel connected to the processor and including a plurality of pixels arranged in a plurality of pixel rows and a plurality of pixel columns grouped into pixel blocks. The at least one processor is configured to supply the first image data to a display unit of the display device when accumulated brightness values of the pixel blocks are uniformly distributed in the accumulated stress map, and to generate shift information to supply a second image data to distribute pixel stress by image shifting a current frame image when accumulated brightness average values of the pixel blocks are non-uniformly distributed in the accumulated stress map.

In an embodiment of the inventive concept, the display panel may include one of an organic light emitting display panel, a liquid crystal display panel, or a plasma display panel.

In an embodiment of the inventive concept, the at least one processor may include a stress calculator having integrated circuitry that is configured to group the pixel blocks in a matrix structure corresponding to a resolution of the display panel.

In an embodiment of the inventive concept, the at least one processor includes a shift range determiner having integrated circuitry configured to calculate a first brightness difference between adjacent pixel rows among pixel blocks, and a second brightness difference between adjacent pixel columns among the pixel blocks.

In an embodiment of the inventive concept, the at least one processor may include includes a stress calculator configured to generate shift stress maps of shifted frame images generated by shifting the current frame images along a plurality of predetermined reference routes within an image display area of the display panel.

BRIEF DESCRIPTION OF THE DRAWINGS

One or more exemplary embodiments of the present inventive concept will now be described more fully hereinafter with reference to the accompanying drawings. However, the examples described herein may be embodied in different forms and should not be construed as limited to the description set forth herein.

In the drawings, dimensions may be exaggerated for clarity of illustration. It will be understood that when an element is referred to as being "between" two elements, the element may be the only element between the two elements, or one or more intervening elements may also be present. Like reference numerals refer to like elements throughout.

DETAILED DESCRIPTION

In the exemplary embodiments according to the inventive concept disclosed herein, a specific structural or functional description is illustrative for the purpose of explaining the exemplary embodiments. In addition, the exemplary embodiments according to the inventive concept may be carried out in various forms. In addition, a person of ordinary skill in the art should appreciate that the present inventive concept is not limited to the embodiments shown and described herein.

Terms such as "first", "second", and the like may be used for describing various constituent elements, but the constituent elements should not be limited to the terms. Such terms may be used for the purpose of discriminating one constituent element from another constituent element, for example, without departing from the scope according to the inventive concept. Accordingly, a first constituent element may be named as a second constituent element, and similarly a second constituent element may be named as a first constituent element.

A person of ordinary skill in the art should appreciate that the singular forms of terms disclosed herein are intended to include the plural forms as well, unless the context clearly indicates otherwise. In the present specification, the terms "include" or "have" indicates that a feature, a number, a step, an operation, a component, a part or the combination thereof described in the specification is present, but does not exclude a possibility of a presence or an addition of one or more other features, numbers, steps, operations, components, parts or combinations thereof, in advance.

If they are not contrarily defined, all terms used herein including technological or scientific terms have the same meaning as those generally understood by a person with ordinary skill in the art. Terms should be interpreted to have the same meaning as the meaning in the context of the related art but are not interpreted as an ideally or excessively formal meaning if it is not clearly defined in this specification.

Hereinafter, exemplary embodiments of the present inventive concept will be described in detail with reference to the accompanying drawings.

Figure 1:
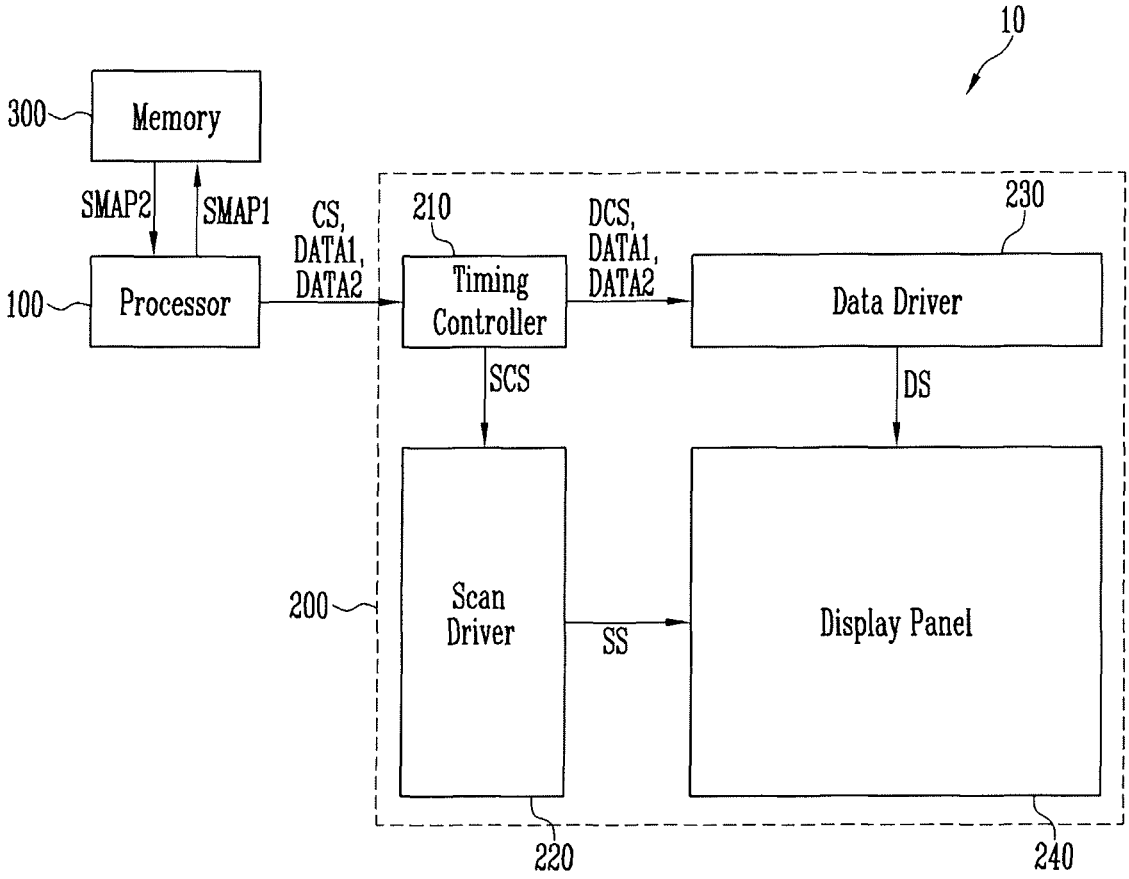
FIG. 1 is a schematic block diagram illustrating a display device according to an exemplary embodiment of the present inventive concept.
Figure 2:
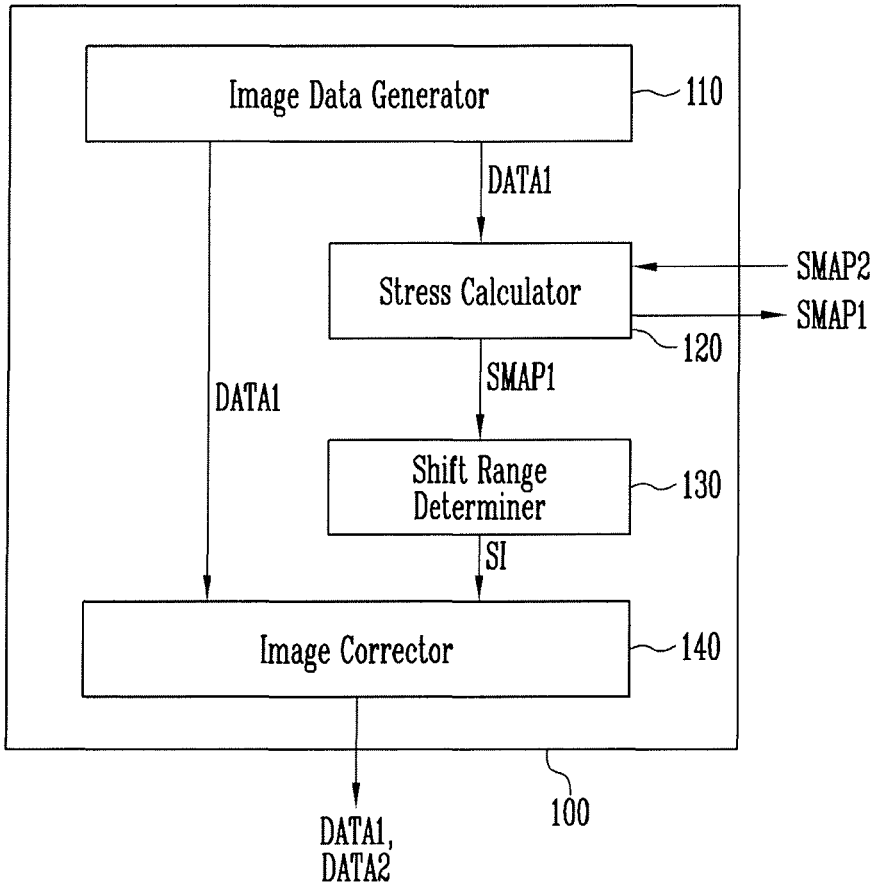
FIG. 2 is a schematic block diagram of a processor according to a exemplary embodiment of the present inventive concept.

FIG. 1 is a schematic block diagram illustrating a display device according to an exemplary embodiment of the inventive concept, and FIG. 2 is a schematic block diagram that provides details of a processor such as illustrated in FIG. 1.

Referring to FIGS. 1 and 2, a display device 10 according to an exemplary embodiment of the present disclosure may include a processor 100, a display unit 200, and a non-transitory memory 300.

The processor 100 may transmit first image data DATA1, second image data DATA2, and a control signal CS to the display unit 200. For example, the processor 100 may be implemented by, for example, an Application Processor (AP), a mobile AP, a Central Processing Unit (CPU), a Graphic Processing Unit (GPU), or a processor being capable of controlling an operation of the display unit 200, but is not limited to the aforementioned examples.

As shown in FIG. 2, the processor 100 may include an image data generator 110, a stress calculator 120, a shift range determiner 130, and an image corrector 140, some or all of which include integrated circuitry that may be embodied on a single chip.

The image data generator 110 may generate a first image data DATA1 to display a current frame image in the display unit 200. The image data generator 110 may provide the first image data DATA1 to the image corrector 140.

The stress calculator 120 may be configured to analyze a brightness distribution of the current frame image based on the first image data DATA1, and generate a stress map of the pixels used to display the current frame image.

More particularly, the stress calculator 120 may group pixels included in the display unit 200 into a plurality of pixel blocks, calculate an average brightness value of each of the pixel blocks, and generate a stress map. Here, the stress map may be an index representing the degree of a deteriorated performance of the pixels included in the pixel blocks displaying the current frame image.

The stress calculator 120 may be configured to generate a stress map based on the first image data DATA1 of the current frame image, and may also generate a first accumulated stress map SMAP1 by using a second accumulated stress map SMAP2 of a previous frame image read from the memory 300. In this example, the first accumulated stress map SMAP1 represents the degree of a deteriorated performance of the pixels included in the pixel blocks displaying the current frame image as an accumulative index that may be generated by applying (e.g. including) the information regarding the stress map of the current frame image to the second accumulated stress map SMAP2 of the previous frame image.

For example, the stress calculator 120 may generate the first accumulated stress map SMAP1 by including an average brightness value of the current frame image to an accumulated average brightness value of the previous frame image.

The stress calculator 120 may provide the first accumulated stress map SMAP1 to the shift range determiner 130.

According to the exemplary embodiment of the inventive concept, the stress calculator 120 may provide the stress map of the current frame image to the shift range determiner 130 without separately calculating the first accumulated stress map SMAP1 of the current frame image. In this case, since the stress calculator 120 does not separately require the second accumulated stress map SMAP2 of the previous frame image to generate the stress map of the current frame image, the stress calculator 120 may not require a separate memory space for storing the second accumulated stress map SMAP2.

The shift range determiner 130 may determine whether to distribute the pixel stress by analyzing the first accumulated stress map SMAP1, and determine a shiftable range of the current frame image based on a result of the determination. The shift range determiner 130 may provide shift range information SI included in the determined shiftable range to the image corrector 140.

According to the exemplary embodiment of the inventive concept, the shift range determiner 130 may calculate a brightness difference of the accumulated brightness average values of the pixel blocks included in the first accumulated stress map SMAP1, compare the brightness difference of the accumulated brightness average values of the pixel blocks with a predetermined reference brightness difference, and determine the shiftable range in accordance with a result of the comparison.

For example, when the brightness difference of the accumulated brightness average values included in the first accumulated stress map SMAP1 is larger than the reference brightness difference, the shift range determiner 130 may determine the shiftable range so that the current frame image is shifted within a broader range than a shiftable range of the previous frame image.

For example, as the brightness difference of the accumulated brightness average values of the pixel blocks adjacent to a specific pixel block is relatively large, the degree of a deteriorated performance of the pixels of the specific pixel block is large. Accordingly, one way that a specific pixel block may be prevented from having deteriorating performance is by the shift range determiner 130 setting the shift range of the current frame image to be broader to reduce/prevent image data of relatively high brightness from being supplied to the pixels of the specific pixel block.

Further, when the accumulated brightness average values included in the first accumulated stress map SMAP1 are evenly (e.g. uniformly) distributed, the deteriorated performance of the pixels is progressing uniformly. When the deteriorated performance of the pixels progresses uniformly, the current frame image may not be shifted, so that the shift range determiner 130 may generate the shift range information SI that is provided to the image corrector 140 indicates that the current frame image is not shifted.

The image corrector 140 may supply the first image data DATA1 or the second image data DATA2 to the display unit 200 based on the shift range information SI.

When the shift range information SI contains the shiftable range of the current frame image, the image corrector 140 may correct (e.g. change) the first image data DATA1 into the second image data DATA2 and supply the second image data DATA2 to the display unit 200 in which display of the current frame image is shifted within the shiftable range.

However, when the shift range information SI contains information, based on which the current frame image is not shifted, the image corrector 140 may supply the first image data DATA1 to the display unit 200, in which case the current frame image is not shifted.

With reference to FIG. 1, the display unit 200 may include, for example, a timing controller 210, a scan driver 220, a data driver 230, and a display panel 240.

The timing controller 210 may receive any one of the first image data DATA1 and the second image data DATA2 from the processor 100. Further, the timing controller 210 may also receive the control signal CS from the processor 100, and generate a scan control signal SCS that is transmitted to the scan driver 220 and a data control signal DCS that is transmitted to the data driver 230 by using the received control signal CS.

The data driver 230 may receive any one of the first image data DATA1 and the second image data DATA2 and the data control signal DCS from the timing controller 210, and generate a data signal DS.

More particularly, the data driver 230 may generate the data signal DS based on the first image data DATA1, or may generate the data signal DS based on the second image data DATA2. The data driver 230 may transmit the generated data signal DS to data lines (not illustrated). According to the exemplary embodiment of the inventive concept, the data driver 230 may be directly mounted in the display panel 240.

The scan driver 220 may supply a scan signal SS to scan lines (not illustrated) based on the scan control signal SCS.

According to the exemplary embodiment of the inventive concept, the scan driver 220 may be directly mounted in the display panel 240.

The display panel 240 may include the pixels, which are connected to the scan lines and the data lines, and display images.

For example, the display panel 240 may be implemented by an organic light emitting display panel, a liquid crystal display panel, a plasma display panel, and the like, but the inventive concept is not limited thereto.

The pixels may be selected in a unit of a horizontal line when the scan signal SS is supplied to the scan lines. The pixels selected by the scan signal SS may receive the data signal DS from the data lines connected with the pixels. The pixels receiving the data signal DS may emit light of a predetermined brightness in response to receiving the data signal DS.

According to the exemplary embodiment of the inventive concept, the data driver 230 and the scan driver 220 may be separately positioned, however the data driver 230 and the scan driver 220 may be combined and positioned.

The memory 300 may store an accumulated stress map. For example, the memory 300 may store the second accumulated stress map SMAP2 of the previous frame image that is read by the processor 100 in response to a read command, and the memory may store the first accumulated stress map SMAP1 of the current frame image in response to a write command by the processor 100.

Figure 3:
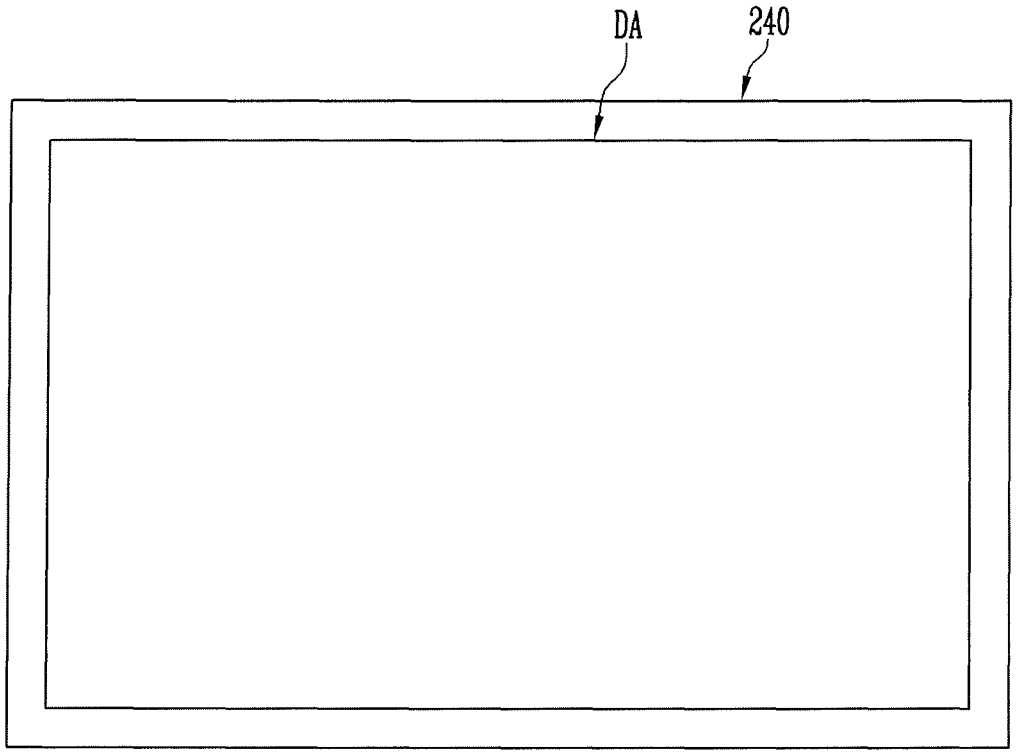
FIG. 3 is a conceptual diagram illustrating an image display area of a display panel according to an exemplary embodiment of the present inventive concept.
Figure 4:
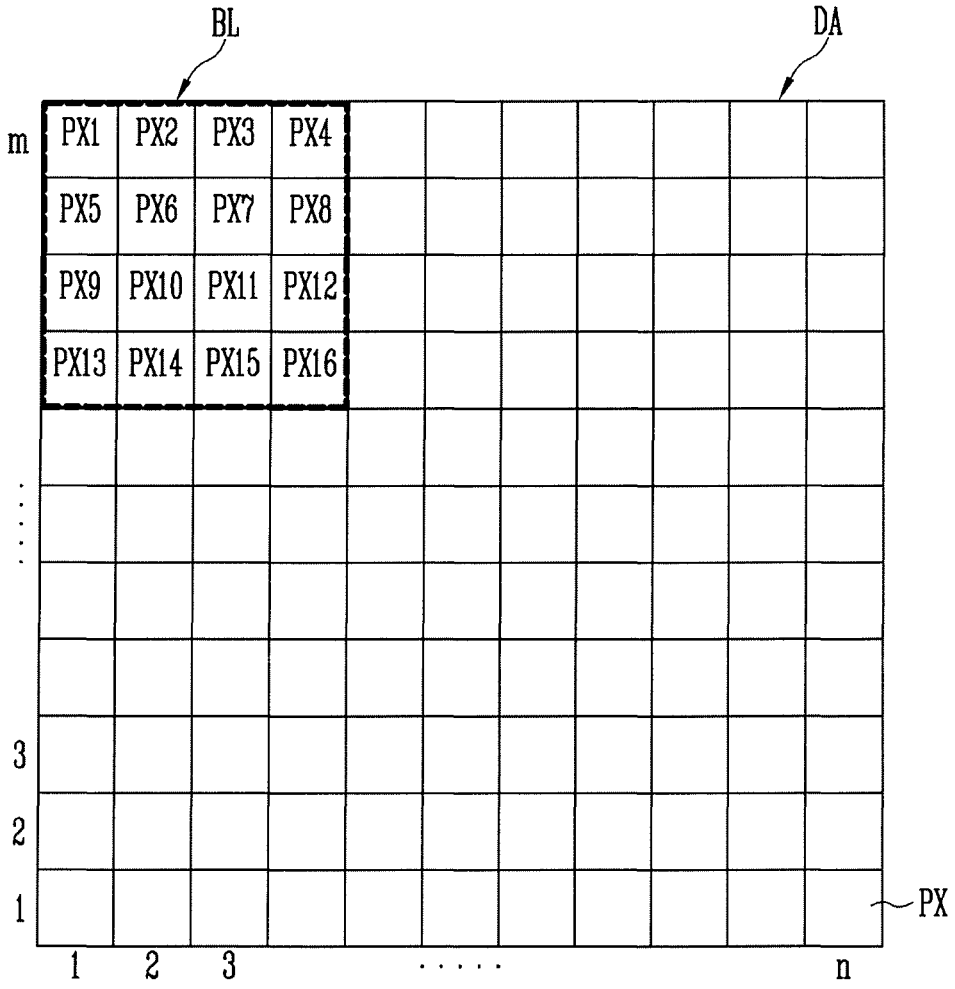
FIG. 4 is a conceptual diagram illustrating pixels included in the image display area illustrated in FIG. 3.

FIG. 3 is a conceptual diagram illustrating an image display area of a display panel according to the exemplary embodiment of the inventive concept, and FIG. 4 is a conceptual diagram illustrating pixels included in the image display area illustrated in FIG. 3.

Referring to FIG. 3, the display panel 240 may include an image display area DA, which includes structure capable of displaying an image. A user of the display panel 240 may view an image displayed on the image display area DA.

The image display area DA may include a plurality of pixels PX which emits light with brightness corresponding to the data signal DS.

Referring to FIG. 4, the image display area DA may include the pixels PX in an m×n matrix structure. For example, when resolution of the display panel 240 is 1920×1080, n may be 1,920, and m may be 1,080.

The stress calculator 120 may group the pixels PX included in the image display area DA into pixel blocks BL. The pixels PX included in each of the pixel block BL may be disposed successively, for example, in a matrix.

According to the exemplary embodiment of the inventive concept, the stress calculator 120 may group the pixels PX in the p×q matrix structure (herein, p and q are natural numbers) into the pixel blocks BL.

For example, with reference to FIG. 4, the stress calculator 120 may group the pixels PX1 to PX16 in the 4×4 matrix structure into one pixel block BL1, and may also group the remaining pixels PX of the display area DA into pixel blocks BL2-BL9 (see FIG. 5) including the pixels PX in the 4×4 matrix structure. A person of ordinary skill in the art should understand that the inventive concept is not limited to a quantity of pixel blocks or the arrangement of pixels in a matrix according to the examples shown and described herein.

Figure 5:
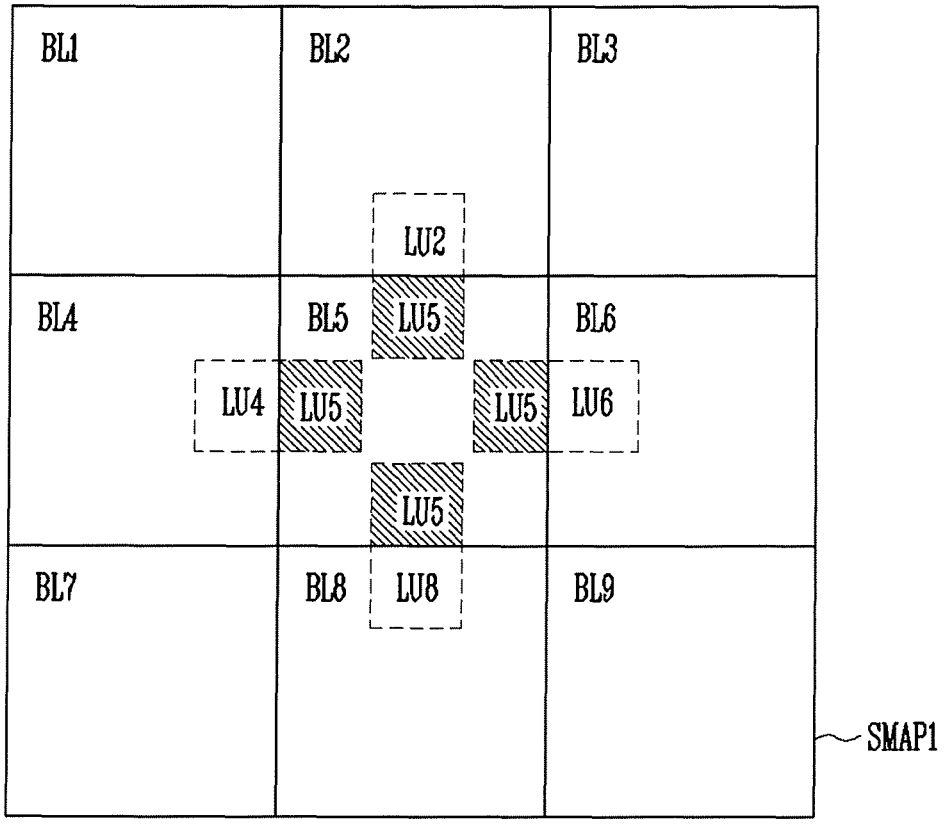
FIG. 5 is a conceptual diagram illustrating a first accumulated stress map according to an exemplary embodiment of the present inventive concept.
Figure 6:
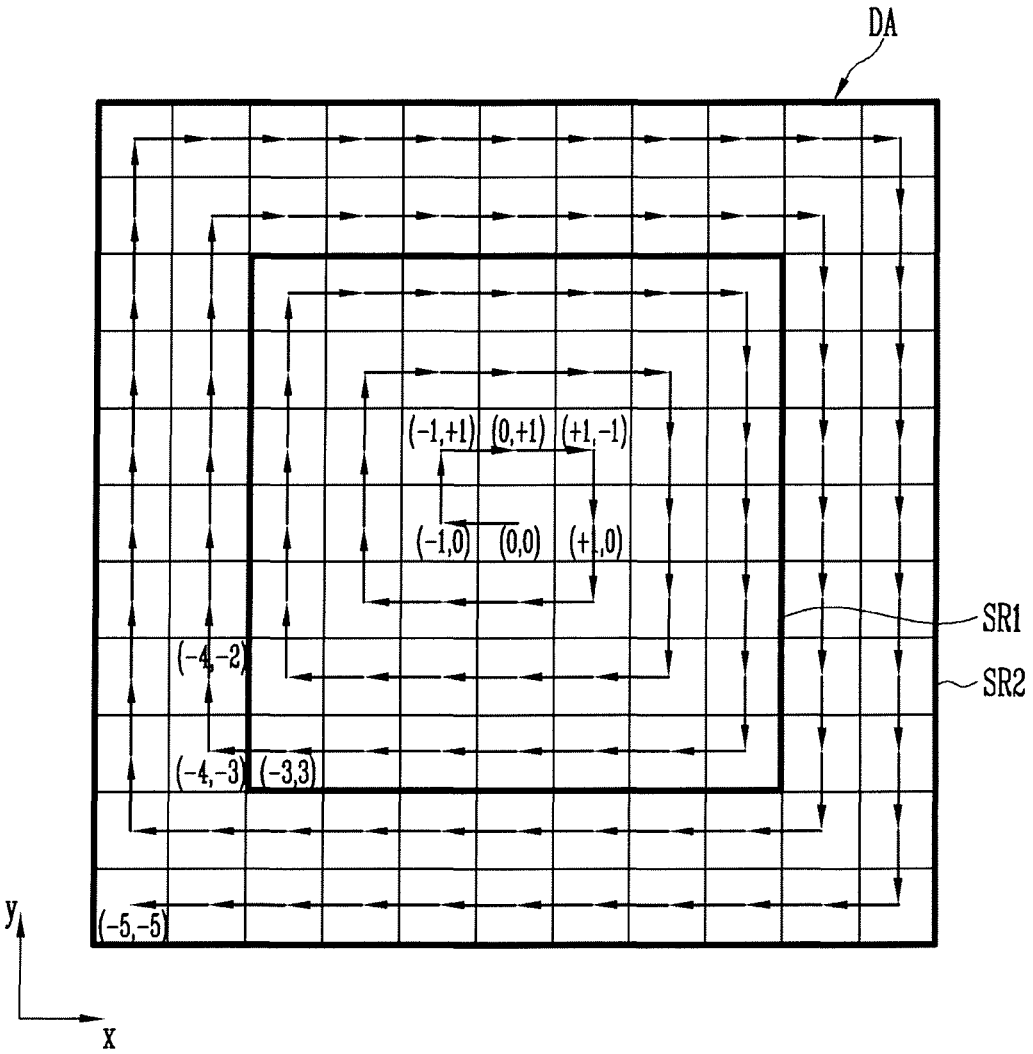
FIG. 6 is a conceptual diagram for describing a method of displaying an image by using a display device according to an exemplary embodiment of the present inventive concept.

FIG. 5 is a conceptual diagram illustrating the first accumulated stress map according to an exemplary embodiment of the present inventive concept, and FIG. 6 is a conceptual diagram that illustrates a method of displaying an image by using the display device according to the exemplary embodiment of the present inventive concept.

Referring to FIG. 5, the stress calculator 120 may average brightness values of the pixels PX included in each of the pixel blocks (e.g. BL1-BL9), and calculate an average brightness value for the current frame image, and generate a stress map of the current frame image including the average brightness value of each pixel block BL. For example, the stress map may include a set of brightness values, with which the pixel blocks BL emit light, respectively, to display the current frame image.

Further, the stress calculator 120 may calculate an average brightness value of each of the pixel blocks BL1-BL9 for every frame image, and average the calculated average brightness value for every frame image again and calculate an accumulated average brightness value for each of the pixel blocks BL. For example, the second accumulated stress map SMAP2 may include a set of accumulated average brightness values, with which the pixel blocks BL emit light from an initial frame image to the previous frame image, respectively.

The stress calculator 120 may instruct storage of the second accumulated stress map SMAP2 in the memory 300, and the processor may read the second accumulated stress map SMAP2 retrieved from the memory 300 to generate the first accumulated stress map SMAP1.

The stress calculator 120 may generate the first accumulated stress map SMAP1 by applying information from a current frame to the second accumulated stress map SMAP2. For example, the stress calculator 120 may calculate accumulated average brightness values, with which the pixel blocks BL1-BL9 have emitted light from the initial frame image to the current frame image, respectively, and generate the first accumulated stress map SMAP1.

In addition, the shift range determiner 130 may determine whether to distribute the pixel stress by analyzing the first accumulated stress map SMAP1, and determining a shiftable range of the current frame image based on a result of the determination.

For example, the shift range determiner 130 may calculate a brightness difference of the accumulated average brightness values of adjacently disposed pixel blocks BL, compare the calculated brightness difference and the reference brightness difference, and determine a shiftable range in accordance with a compared result.

For example, when the brightness difference of the accumulated brightness average values included in the first accumulated stress map SMAP1 is larger than the reference brightness difference, the shift range determiner 130 may determine a shiftable range in which the current frame image is shifted within a broader range than a shiftable range of the previous frame image.

According to the exemplary embodiment, the shift range determiner 130 may calculate a first brightness difference between the adjacent rows among the pixel blocks BL, and a second brightness difference between the adjacent columns among the pixel blocks BL, and when at least one of the first brightness difference and the second brightness difference is larger than the reference brightness difference, the shift range determiner 130 may determine the shiftable range as a first shiftable range. In addition, when the first brightness difference and the second brightness difference are smaller than the reference brightness difference, the shift range determiner 130 may determine the shiftable range as a second shiftable range. In this case, the first shiftable range includes a broader range than the second shiftable range.

The shift range determiner 130, for example, may calculate a first brightness difference and a second brightness difference of each of the pixel blocks BL1 to BL9.

More particularly, with reference to FIG. 5, the shift range determiner 130 may compare an accumulated brightness average value LU5 of the fifth pixel block BL5 and an accumulated brightness average value LU2 of the second pixel block BL2, and compare the accumulated brightness average value LU5 of the fifth pixel block BL5 and an accumulated brightness average value LU8 of the eighth pixel block BL8 to calculate the first brightness difference.

For example, the shift range determiner 130 may compare the accumulated brightness average value LU5 of the fifth pixel block BL5 and an accumulated brightness average value LU4 of the fourth pixel block BL4, and compare the accumulated brightness average value LU5 of the fifth pixel block BL5 and an accumulated brightness average value LU6 of the sixth pixel block BL6 to calculate the second brightness difference.

Referring to FIG. 6, a shift route of an image shifted within the image display area DA is illustrated. The image corrector 140 may correct (e.g. change) the first image data DATA1 to the second image data DATA2 in which the current frame image is shiftable along a direction of an arrow within the shiftable range by using the shift range information SI provided from the shift range determiner 130.

In this case, the display unit 200 may display the image shifted in the direction of the arrow whenever receiving the second image data DATA2 from the processor 100. For example, when it is assumed that a start point of the shift of the image is coordinates (0, 0), the display unit 200 may display the current frame image shifted in an x-axis direction or a y-axis direction whenever receiving the second image data DATA2.

With continued reference to FIG. 6, for example, when it is assumed that a center of the first frame image is displayed at the coordinates (0, 0), the second frame image may be displayed while being shifted to the left side along the −x axis so that a center of the second frame image is displayed at coordinates (−1, 0). When the current frame image is the third frame image, the current frame image may be displayed while being shifted to a left-upper end along the −x-axis direction and a +y-axis direction so that a center of the current frame image is displayed at coordinates (−1, +1).

The current frame image may be displayed while being shifted along the shift route by the aforementioned method, but may be shiftable, for example, within the shiftable range included in the shift range information SI.

For example, the shift range determiner 130 may calculate a brightness difference of the accumulated average brightness values of the pixel blocks BL of the first accumulated stress map SMAP1, and when the brightness difference is smaller than the reference brightness difference, the shift range determiner 130 may determine the shiftable range as a first shiftable range SR1 (e.g. shown in FIG. 6), and when the brightness difference is larger than the reference brightness difference, the shift range determiner 130 may determine the shiftable range as a second shiftable range SR2.

When the current frame image is displayed while being shifted along the direction of the arrow within the first shiftable range SR1, the center of the current frame image may be displayed at coordinates (−3, −3), but cannot be displayed at coordinates (−4, −4).

However, when the current frame image is displayed while being shifted along the direction of the arrow within the second shiftable range SR2, the center of the current frame image may also be displayed at coordinates (−5, −5), as well as coordinates (−4, −3).

Since the large brightness difference (e.g. larger than the reference brightness difference) indicates that the degree of a deteriorated performance of the pixels PX is relatively large, the shift range determiner 130 may disperse stress and broadly set the shiftable range that may prevent the pixels PX from deteriorating.

For example, when the brightness difference is smaller than the reference brightness difference, the shift range determiner 130 may determine that an amount of pixel stress to be dispersed is relatively low, and determine that a narrow shiftable range may be used. When the brightness difference is larger than the reference brightness difference, the shift range determiner 130 may determine that a broader shiftable range may be used.

Further, the shift range determiner 130 may determine an appropriate shiftable range to disperse the stress by analyzing the accumulated stress map generated for every frame image, and individually determine the shiftable range for every frame image.

For example, even though the shiftable range of the previous frame image is the second shiftable range SR2, the shiftable range of the current frame image may be determined to be the first shiftable range SR1. In this case, when the center of the previous frame image is shifted to the coordinates (−4, −3) and displayed, the current frame image may be shifted so that the center of the current frame image is not displayed at coordinates (−4, −2), but is displayed at the coordinates (−3, −3).

For example, the inventive concept is not limited to shiftable ranges shown and described herein. For example, the shift route of the image may not always follow the direction of the arrow, and may be changed in accordance with the shiftable range determined for every frame image.

Figure 7:
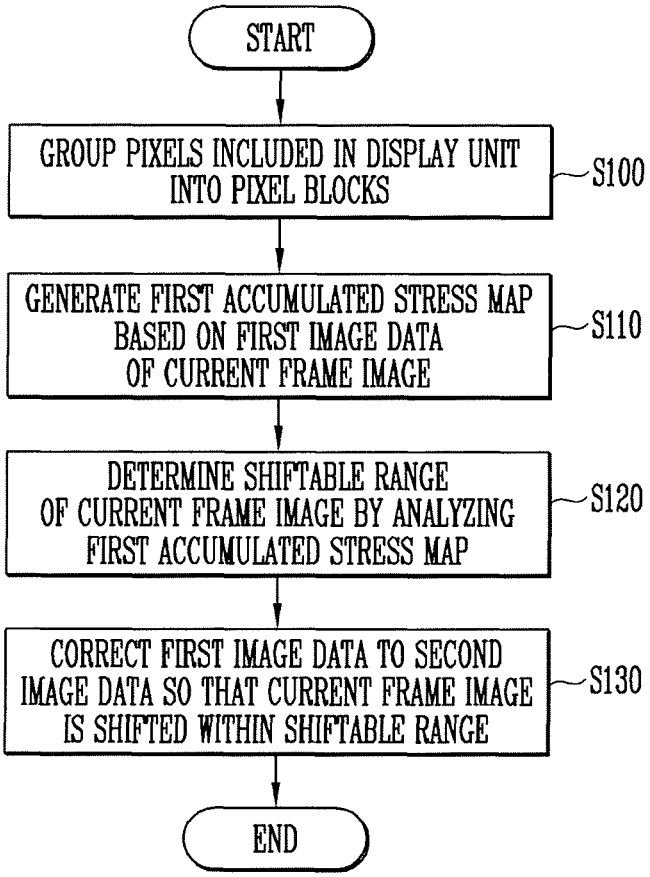
FIG. 7 is a flowchart describing the method of displaying the image by the display device according to an exemplary embodiment of the present inventive concept.

FIG. 7 is a flowchart illustrating the method of displaying the image by the display device according to the exemplary embodiment of the inventive concept.

Referring to FIG. 7, the stress calculator 120 may group the pixels PX included in the display unit 200 into a plurality of pixel blocks BL (S100).

The stress calculator 120 may generate a first accumulated stress map SMAP1, which represents a degree of a deteriorated performance of the pixels PX included in the pixel blocks BL, based on a first image data DATA1 of a current frame image provided from the image data generator 110 (S110).

The shift range determiner 130 may determine a shiftable range of the current frame image by analyzing the first accumulated stress map SMAP1 (S120).

Next, the image corrector 140 may correct (change) the first image data DATA1 to the second image data DATA2 in which display of the current frame image is shifted within the shiftable range.

Figure 8:
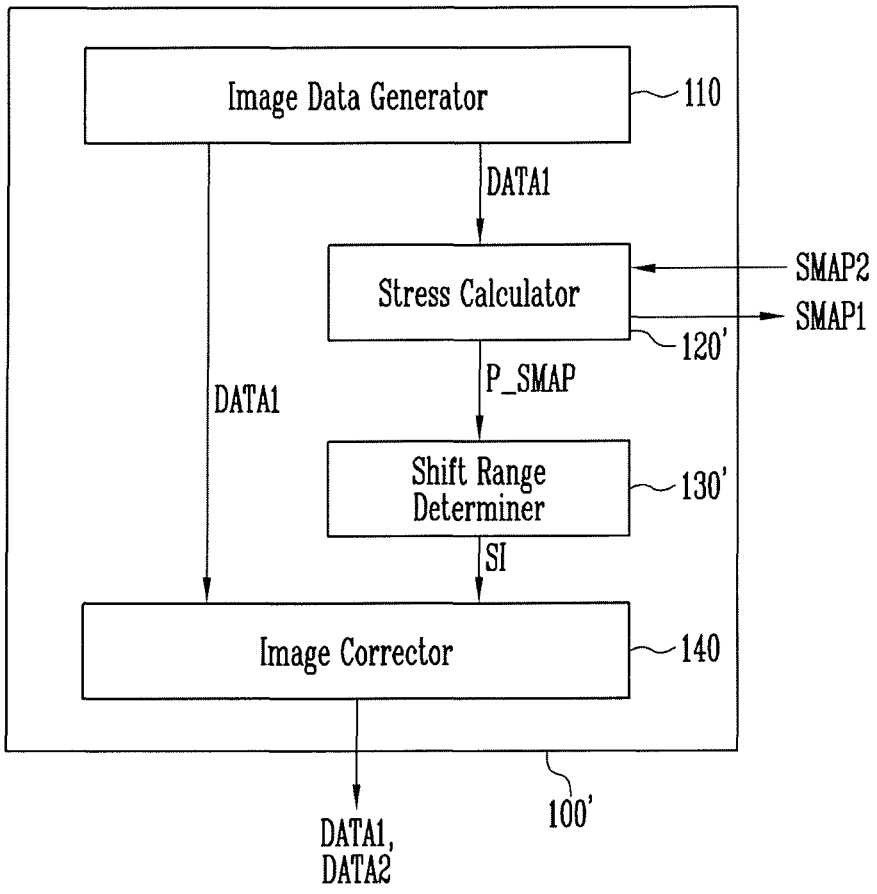
FIG. 8 is a schematic block diagram of a processor according to an exemplary embodiment of the present inventive concept.

FIG. 8 is a schematic block diagram of a processor according to an exemplary embodiment of the inventive concept.

A processor 100' according to the exemplary embodiment of the inventive concept illustrated in FIG. 8 will be described based on a different point from that of the processor 100 illustrated in FIG. 2. Parts, which are not specially described with reference to FIG. 8, will follow those of the processor 100 previously described, and the same reference numeral refers to the same element, and the similar reference numeral refers to a similar element.

Referring to FIG. 8, a stress calculator 120' may analyze a brightness distribution of a current frame image based on first image data DATA1, and generate a stress map. The stress calculator 120' may generate the first accumulated stress map SMAP1 by applying (including) information in the stress map to a second accumulated stress map SMAP2.

The stress calculator 120' may generate an expected accumulated stress map P_SMAP, in which the degree of a deteriorated performance of the pixels PX according to the shift of the current frame image within the display unit 200 is expected.

Particularly, the stress calculator 120' may calculate a shift stress map of a shifted frame image, which is the current frame image shifted by a predetermined amount in the x-axis direction or the y-axis direction within the display unit 200, and generate the expected accumulated stress map P_SMAP by applying the shift stress map to the first accumulated stress map SMAP1.

Here, the shift stress map may refer to an index representing the degree of a deteriorated performance of the pixels PX included in the pixel blocks BL displaying the shifted frame image. Further, the expected accumulated stress map P_SMAP represents the degree of a deteriorated performance of the pixels PX included in the pixel blocks BL displaying the shifted frame image as an accumulative index, and the expected accumulated stress map may be generated by applying the shift stress map of the shifted frame image to the first accumulated stress map SMAP1.

The shift range determiner 130' may analyze the expected accumulated stress map P_SMAP provided from the stress calculator 120', and determine a shift route, in which the degree of a deteriorated performance of the pixels is smallest (e.g. lowest). The shift range determiner 130' may provide the shift range information SI including the determined shift route to the image corrector 140.

The image corrector 140 may correct the first image data DATA1 to second image data DATA2 in which the current frame image is shifted in response to the shift route included in the shift range information SI.

However, when the shift range information SI does not contain the shift route of the current frame image, the image corrector 140 may supply the first image data DATA1 to the display unit 200 so that the current frame image is not shifted. For example, the current frame image may not be shifted (the shift range information SI does not contain the shift route of the current frame image) is because the shift range determiner 130' may determine that the current frame image is not shifted based on the amount of pixel stress.

Figure 9:
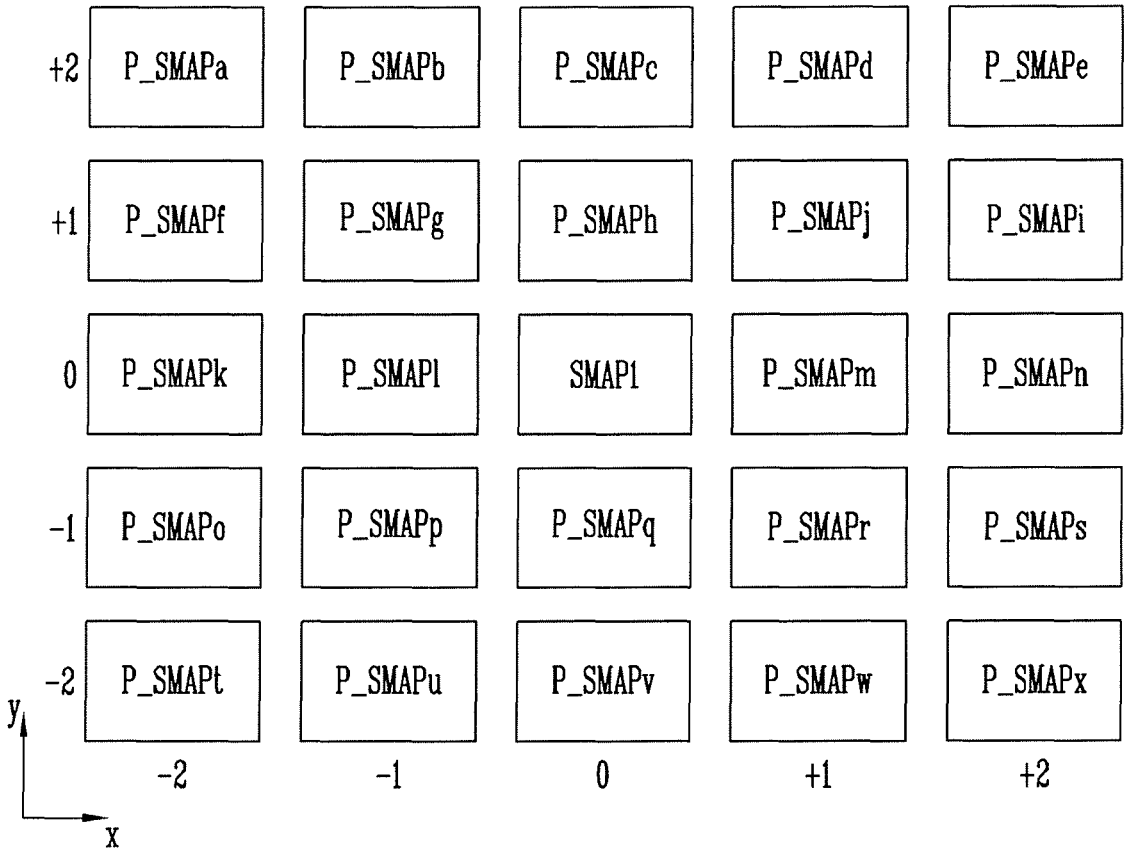
FIG. 9 is a conceptual diagram for describing a method of generating, by a display device, an expected accumulated stress map of all of the routes and determining a shift route of a current frame image according to an exemplary embodiment of the present inventive concept.

FIG. 9 is a conceptual diagram illustrating a method of generating, by a display device, an expected accumulated stress map of all of the routes and determining a shift route of a current frame image according to an exemplary embodiment of the present disclosure.

Referring to FIG. 9, the stress calculator 120' (FIG. 8) may generate shift stress maps of shifted frame images generated by shifting the current frame images by a predetermined amount along all of the shiftable routes within the image display area DA.

For example, the stress calculator 120' may calculate a brightness distribution of the shifted frame image generated by shifting the current frame images to all of the coordinates within the image display area DA, and generate shift stress maps of the shifted frame images, which are shifted to all of the coordinates, by using the calculated brightness distribution.

Further, the stress calculator 120' may generate expected accumulated stress maps P_SMAPa to P_SMAPx (FIG. 9) corresponding to the coordinates, respectively, by applying the shift stress map of each of the shifted frame images shifted to all of the coordinates to the first accumulated stress map SMAP1.

For example, the first expected accumulated stress maps P_SMAPa may represent the degree of a deteriorated performance of the pixels PX when the current frame image is shifted to and displayed at coordinates (−2, +2), and the second expected accumulated stress maps P_SMAPb may represent the degree of a deteriorated performance of the pixels PX when the current frame image is shifted to and displayed at coordinates (−1, +2).

According to the inventive concept, the shift range determiner 130' may analyze the expected accumulated stress maps P_SMAPa to P_SMAPx of all of the routes provided from the stress calculator 120', and determine a minimum stress map, in which the degree of a deteriorated performance of the pixels PX is smallest, from among the expected accumulated stress maps P_SMAPa to P_SMAPx.

For example, the shift range determiner 130' may determine an expected accumulated stress map, in which a brightness difference between the adjacent pixel blocks BL is relatively small, from among the expected accumulated stress maps P_SMAPa to P_SMAPx (e.g. FIG. 9) as a minimum stress map.

Further, the shift range determiner 130' may determine a shift route for the minimum stress map as a shift route of the current frame image.

The image corrector 140 may correct (e.g. change) the first image data DATA1 to the second image data DATA2 in which the current frame image is shifted in display along the shift route for the minimum stress map.

Figure 10:
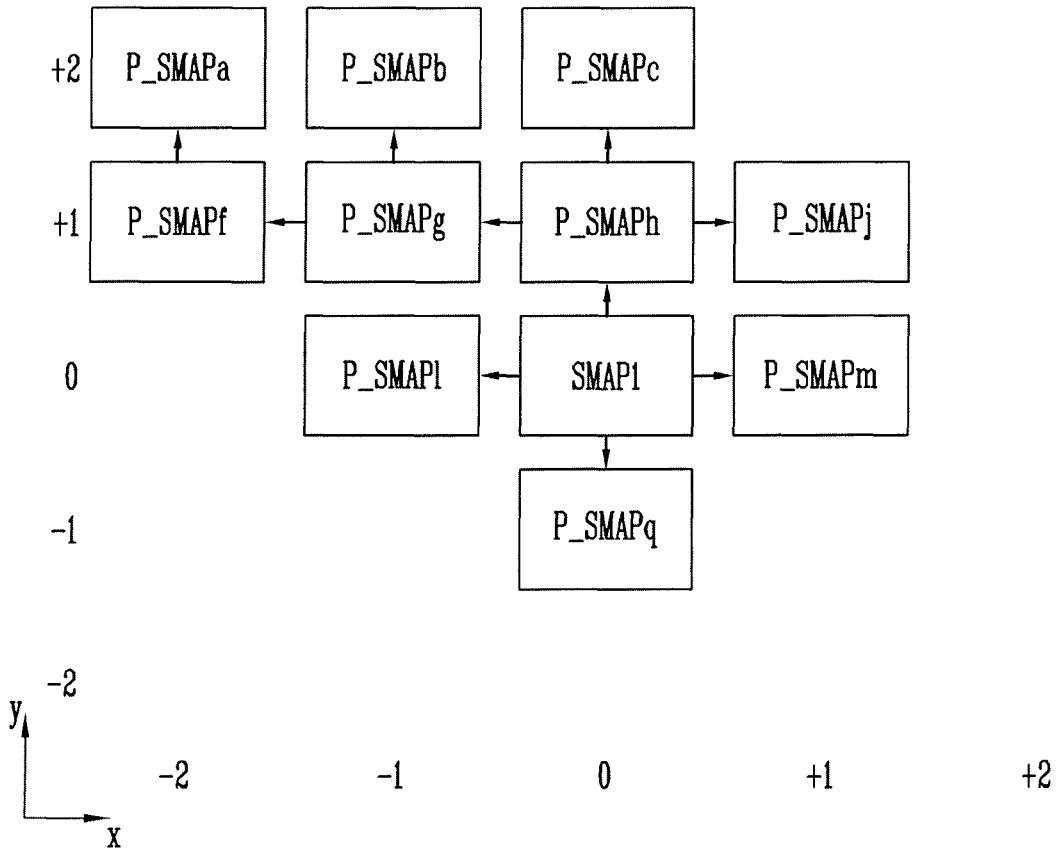
FIG. 10 is a conceptual diagram for describing a method of generating, by the display device, an expected accumulated stress map of a route, in which the degree of a deteriorated performance of a pixel is smallest, and determining a shift route of a current frame image according to an exemplary embodiment of the present inventive concept.

FIG. 10 is a conceptual diagram for describing a method of generating, by the display device, an expected accumulated stress map of a route, in which the degree of a deteriorated performance of the pixel PX is smallest, and determining a shift route of the current frame image according to an exemplary embodiment of the present disclosure.

Referring to FIG. 10, the stress calculator 120' may generate shift stress maps of shifted frame images generated by shifting the current frame images by the predetermined amount along the shortest shiftable route within the image display area DA.

For example, the stress calculator 120' (FIG. 8) may generate a shift stress map of a shifted frame image, which is the current frame image shifted by "1" in the −x-axis direction, a shift stress map of a shifted frame image, which is the current frame image shifted by "1" in the +x-axis direction, a shift stress map of a shifted frame image, which is the current frame image shifted by "1" in the −y-axis direction, and a shift stress map of a shifted frame image, which is the current frame image shifted by "1" in the +y-axis direction.

Further, the stress calculator 120' may generate expected accumulated stress maps corresponding to the coordinates, respectively, by applying the shift stress map of each of the shifted frame images shifted along the shortest route to the first accumulated stress map SMAP1.

For example, a third expected accumulated stress map P_SMAPl may represent the degree of a deteriorated performance of the pixels PX when the current frame is shifted to and displayed at coordinates (−1, 0), a fourth expected accumulated stress map P_SMAPm may represent the degree of a deteriorated performance of the pixels PX when the current frame is shifted to and displayed, for example, at coordinates (+1, 0), a fifth expected accumulated stress map P_SMAPh may represent the degree of a deteriorated performance of the pixels PX when the current frame is shifted to and displayed at coordinates (0, +1), and a sixth expected accumulated stress map P_SMAPq may represent the degree of a deteriorated performance of the pixels PX when the current frame is shifted to and displayed at coordinates (0, −1).

The shift range determiner 130 may determine a minimum stress map from among the expected accumulated stress maps P_SMAPl, P_SMAPm, P_SMAPh, and P_SMAPq. Again, the stress calculator 120' may generate shift stress maps of shifted frame images generated by shifting the current frame images by the predetermined amount along the shortest route in the coordinates of the minimum stress map, and generate expected accumulated stress maps P_SMAPc, P_SMAPg, and P_SMAPj by applying the shift stress maps to the first accumulated stress map SMAP1.

For example, when the fifth expected accumulated stress map P_SMAPh among the third to sixth expected accumulated stress maps P_SMAPl, P_SMAPm, P_SMAPh, and P_SMAPq is determined as the minimum stress map, the stress calculator 120' may generate shift stress maps of the shifted frame images generated by shifting the current frame images to coordinates (−1, +1), (0, +2), and (+1, +1).

Further, the stress calculator 120' may generate expected stress maps by applying the shift stress maps, which correspond to the coordinates (−1, +1), (0, +2), and (+1, +1), respectively, to the first accumulated stress map SMAP1. Further, the shift range determiner 130' may determine a minimum stress map from among the generated expected accumulated stress maps P_SMAPc, P_SMAPg, and P_SMAPj.

By the same method, the shift range determiner 130' may determine a final minimum stress map, and may determine a shift route for the final minimum stress map as a shift route of the current frame image.

For example, when the first expected accumulated stress maps P_SMAPc is determined as the final minimum stress map, the shift range determiner 130' may determine the shift route so that the current frame image is shiftable to the coordinates (−2, +2).

The image corrector 140 may correct the first image data DATA1 to the second image data DATA2 in which the current frame image is shiftable along the shift route for the final minimum stress map.

Figure 11:
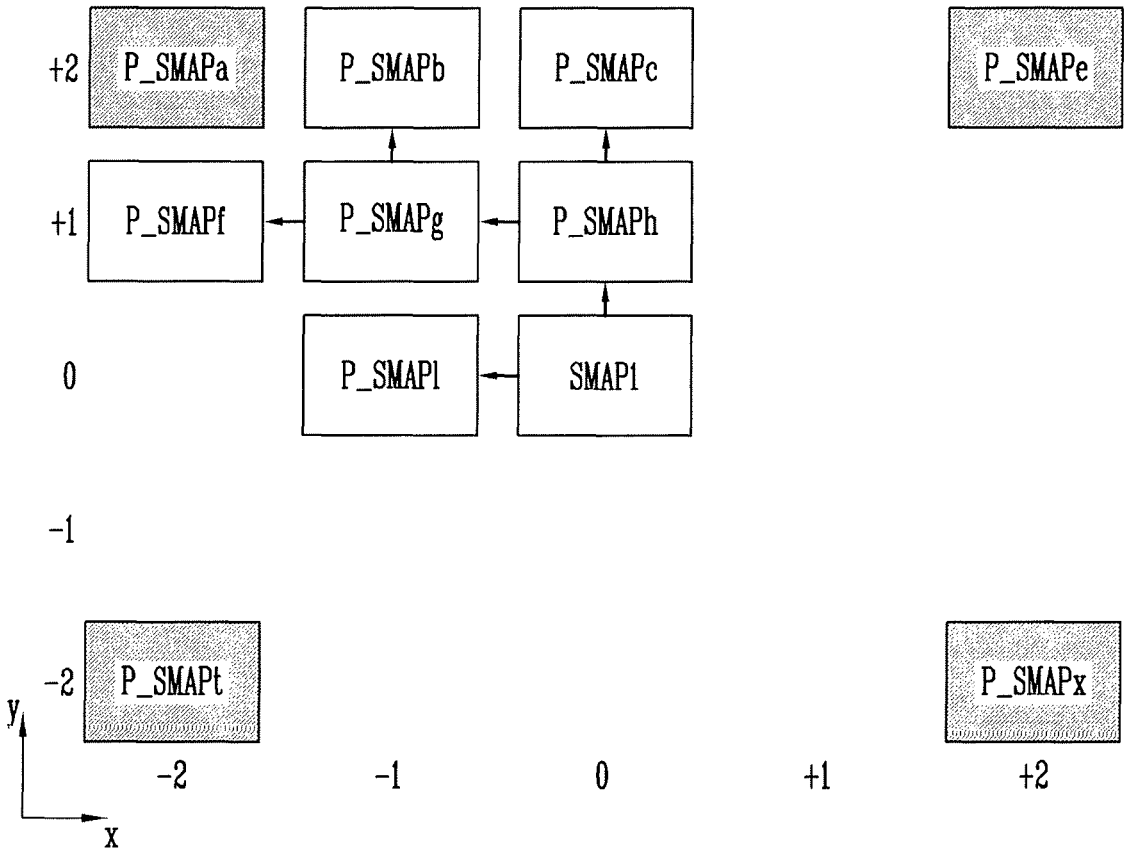
FIG. 11 is a conceptual diagram for describing a method of generating, by the display device, an expected accumulated stress map of a selected reference route and determining a shift route of a current frame image according to an exemplary embodiment of the present inventive concept.

FIG. 11 is a conceptual diagram for describing a method of generating, by the display device, an expected accumulated stress map of a selected reference route and determining a shift route of a current frame image according to an exemplary embodiment of the inventive concept.

Referring to FIG. 11, the stress calculator 120' may generate shift stress maps of shifted frame images generated by shifting the current frame images along the plurality of predetermined reference routes within the image display area DA. Further, the stress calculator 120' may generate expected accumulated stress maps for the plurality of reference routes by applying the shift stress maps to the first accumulated stress map SMAP1.

For example, as can be seen in FIG. 11, when reference coordinates of the plurality of reference routes are coordinates (−2, +2), (+2, +2), (−2, −2), and (+2, −2), the stress calculator 120' (FIG. 8) may generate shift stress maps of the shifted frame image shifted to the coordinates (−2, +2), (+2, +2), (−2, −2), and (+2, −2), respectively. Further, the stress calculator 120' may generate expected accumulated stress maps P_SMAPa, P_SMAPe, P_SMAPt, and P_SMAPx by applying the shift stress maps for the coordinates (−2, +2), (+2, +2), (−2, −2), and (+2, −2) to the first accumulated stress map SMAP1.

The shift range determiner 130' (FIG. 8) may determine a minimum stress map among the generated expected accumulated stress maps P_SMAPa, P_SMAPe, P_SMAPt, and P_SMAPx. Again, the stress calculator 120' may generate expected accumulated stress maps of the routes, along which the current frame image is shifted to the minimum stress map.

The shift range determiner 130' may determine a final minimum stress map from among the generated expected accumulated stress maps. The shift range determiner 130' may determine a shift route for the final minimum stress map as a shift route of the current frame image.

For example, when the first expected accumulated stress map P_SMAPa among the expected accumulated stress maps P_SMAPa, P_SMAPe, P_SMAPt, P_SMAPx is determined as the minimum stress map, the stress calculator 120' may generate the expected accumulated stress maps for the routes to the coordinates (−2, +2).

In this example, the shift range determiner 130' may determine the minimum stress map between the third expected accumulated stress map P_SMAP1 generated by shifting the current frame image to the coordinates (−1, 0) and the fifth expected accumulated stress map P_SMAPh generated by shifting the current frame image to the coordinates (0, +1).

Further, the stress calculator 120' may generate expected accumulated stress maps for the route from the coordinates of the minimum stress map to the coordinates (−2, +2). For example, when the fifth expected accumulated stress map P_SMAPh is determined as the minimum stress map, the stress calculator 120' may not generate the expected accumulated stress maps for the route from the coordinates (−1, 0) to the coordinates (−2, +2), but may generate the expected accumulated stress maps for the route from the coordinates (0, +1) (e.g. the coordinates of P_SMAPh) to the coordinates (−2, +2).

When the seventh expected accumulated stress maps P_SMAPf from among the expected accumulated stress maps is determined as the final minimum stress map, the shift range determiner 130' may determine the shift route so that the current frame image is shiftable to the coordinates (−2, +1).

The image corrector 140 may correct the first image data DATA1 to the second image data DATA2 in which display of the current frame image is shiftable along the shift route for the final minimum stress map.

According to the inventive concept, the stress calculator 120' may decrease an unnecessary calculating process, and may more rapidly determine a shift route of the current frame image.

Figure 12:
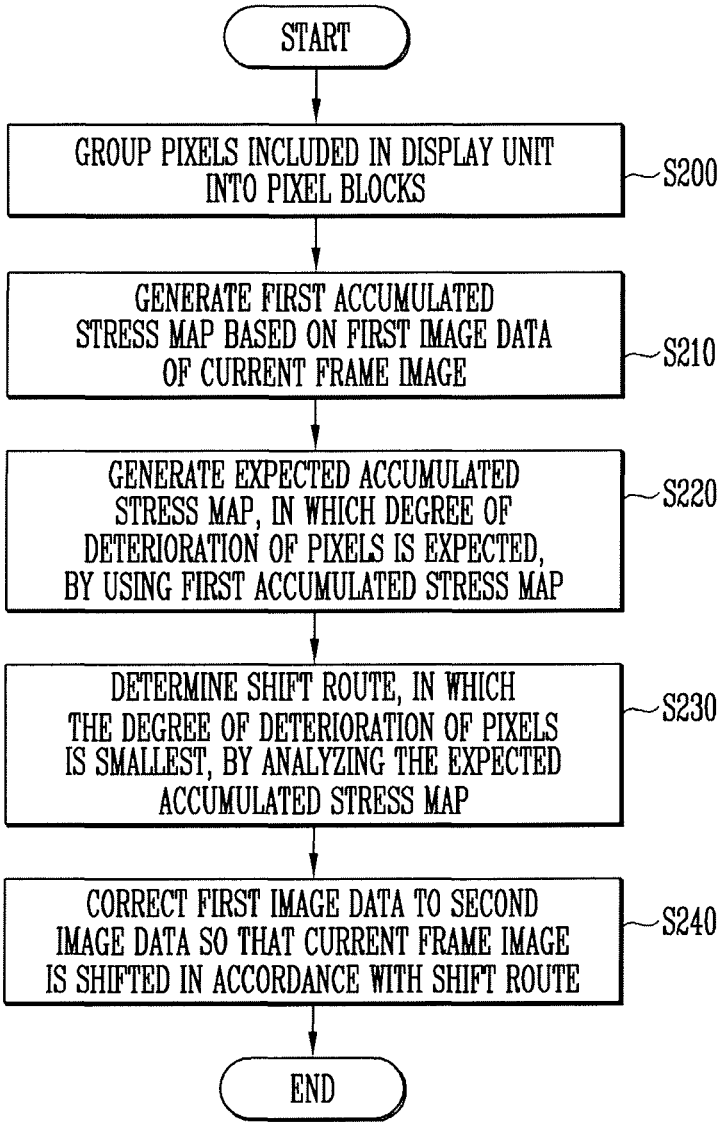
FIG. 12 is a flowchart describing a method of displaying an image by using a display device according to an exemplary embodiment of the present inventive concept.

FIG. 12 is a flowchart illustrating a method of displaying an image by using a display device according to an exemplary embodiment of the inventive concept.

Referring to FIG. 12, the stress calculator 120' may group the pixels PX included in the display unit 200 into the pixel blocks BL (S200).

The stress calculator 120' may then generate a first accumulated stress map SMAP1, which represents a degree of a deteriorated performance of the pixels PX included in the pixel blocks BL, based on first image data DATA1 of a current frame image provided from the image data generator 110 (S210).

The stress calculator 120' may generate an expected accumulated stress map P_SMAP, in which the degree of a deteriorated performance of the pixels PX according to the shift of the current frame image within the display unit 200 is expected, by using the first accumulated stress map SMAP1.

Further, the shift range determiner 130 may determine a shift route, in which the degree of a deteriorated performance of the pixels PX is smallest, by analyzing the expected accumulated stress map (S230).

Next, the image corrector 140 may correct the first image data DATA1 to second image data DATA2 in which display of the current frame image is shifted in accordance with the shift route (S240).

The inventive concept has been described with reference to the exemplary embodiment illustrated in the drawing, but the exemplary embodiment is only illustrative, and it would be appreciated by those skilled in the art that various modifications and equivalent exemplary embodiments may be made.

What is claimed is:

1. A method of displaying an image, the method comprising:

grouping a plurality of pixels included in a display panel of a display device into respective pixel blocks, the display panel divided into a first part including some of the pixels and a second part including the first part and the remaining pixels;

generating a first accumulated stress map representing a degree of a deteriorated performance of the pixels in the respective pixel blocks based on a first image data of a current frame image;

determining a shiftable range of display of the current frame image based on a content of the first accumulated stress map in which a shift range information included in the shiftable range indicates whether a display of the current frame image by the respective pixel blocks is to be shifted, the shiftable range including coordinates of only the first part when a brightness difference of average brightness values of the pixel blocks of the first accumulated stress map is smaller than a reference brightness difference, and including coordinates of the second part when the brightness difference is greater than the reference brightness difference; and displaying the first image data or a second image data of the current frame in response to the shift range information, wherein the second image data is provided by correcting the first image data to the second image data based on the shift range information indicating that the display of the current frame image by the display panel is shifted in a direction within the shiftable range indicated by the shift range information, wherein the second image data includes a section of the first image data at a first coordinate within the first part shifted to a second coordinate different from the first coordinate within the shiftable range.

2. The method of claim 1, wherein the generating of the first accumulated stress map includes:

calculating an average brightness value of each of the respective pixel blocks, generating a stress map of the current frame image including the average brightness value, reading a second accumulated stress map of a previous frame image from a memory, and generating the first accumulated stress map by applying the stress map of the current frame to the second accumulated stress map of the previous frame.

3. The method of claim 1, wherein the determining of the shiftable range includes calculating a brightness difference between adjacently disposed respective pixel blocks by analyzing the first accumulated stress map, comparing the brightness difference with a reference brightness difference, and determining the shiftable range in accordance with a compared result.

4. The method of claim 1, wherein the determining of the shiftable range includes calculating a first brightness difference between adjacent rows among the respective pixel blocks, calculating a second brightness difference between adjacent columns of pixels from among the respective pixel blocks, determining the shiftable range as a first shiftable range when any one of the first brightness difference and the second brightness difference is larger than a reference brightness difference, and determining the shiftable range as a second shiftable range when the first brightness difference and the second brightness difference are smaller than the reference brightness difference, and the first shiftable range includes a broader range than the second shiftable range.

5. A method of displaying an image by using a display device, the method comprising:

grouping pixels included in a display panel of the display device into respective pixel blocks, the display panel divided into a first part including some of the pixels and a second part including the first part and the remaining pixels;

generating a first accumulated stress map representing a degree of a deteriorated performance of the pixels in the respective pixel blocks based on a first image data of a current frame image;

generating an expected accumulated stress map, in which the degree of the deteriorated performance of the pixels according to a shift of a display of the current frame image by the display device is expected, based on the first accumulated stress map;

determining a shiftable display route, in which the degree of the deteriorated performance of the pixels is smallest, based on a content of the expected accumulated stress map; and correcting the first image data to second image data in which display of the current frame image is shifted in accordance with the shiftable display route, wherein the shiftable display route includes display coordinates for display of the second image data of the current image frame along the shiftable display route, wherein the shiftable display route is a first shiftable route that passes through coordinates of only the first part when a brightness difference of average brightness values of the pixel blocks of the first accumulated stress map is smaller than a reference brightness difference, and wherein the shiftable display route is a second shiftable route that passes through the first part and coordinates of the second part when the brightness difference is greater than the reference brightness difference.

6. The method of claim 5, wherein the generating of the first accumulated stress map includes calculating an average brightness value of each of the respective pixel blocks, generating a stress map of the current frame image including the average brightness value by reading a second accumulated stress map of a previous frame image from a memory, and generating the first accumulated stress map by applying the stress map of the current frame image to the second accumulated stress map of the previous frame image.

7. The method of claim 5, wherein the generating of the expected accumulated stress map includes calculating a shift stress map of a shifted frame image generated by shifting display of the current frame image by a predetermined amount in an x-axis direction or a y-axis direction within the display device, and generating the expected accumulated stress map by applying the shift stress map to the first accumulated stress map.

8. The method of claim 5, wherein the generating of the expected accumulated stress map includes calculating shift stress maps of shifted frame images generated by shifting the current frame image by a predetermined amount along all of a plurality of shiftable display routes by the display device, and generating the expected accumulated stress maps by applying each of the calculated shift stress maps to the first accumulated stress map.

9. The method of claim 8, wherein the determining of the shiftable display route includes determining a minimum stress map, in which the degree of the deteriorated performance of the pixels is smallest, among the expected accumulated stress maps, and determining a first shift route for the minimum stress map as the shift route.

10. The method of claim 5, wherein the generating of the expected accumulated stress map includes calculating shift stress maps of shifted frame images generated by shifting the current frame image along a plurality of predetermined reference routes within the display device, generating reference accumulated stress maps by applying each of the shift calculated stress maps to the first accumulated stress map, and determining a minimum stress map, in which the degree of the deteriorated performance of the pixels is smallest, among the reference accumulated stress maps as the expected accumulated stress map.

11. A display device, comprising:

a processor configured to generate a stress map representing a degree of a deteriorated performance of blocks of pixels by using a brightness distribution of a current frame image, and generating image data, which shifts display of the current frame image in a determined direction along a shift route based on the stress map; and a display panel including the pixels and configured to display an image by using the image data, the display panel divided into a first part including some of the pixels and a second part including the first part and the remaining pixels, wherein the brightness distribution is generated by shifting the current frame image to all coordinates within a display area of the display panel, wherein the shift route passes through coordinates of only the first part when a brightness difference of average brightness values of the pixel blocks of the stress map is smaller than a reference brightness difference, and wherein the shift route passes through coordinates of the second part when the brightness difference is greater than the reference brightness difference.

12. The display device of claim 11, wherein the processor includes:

first integrated circuitry configured to generate a first image data of the current frame image;

second integrated circuitry configured to determine a brightness distribution of the current frame image based on the first image data, and generate the stress map;

third integrated circuitry configured to determine whether to shift a display of the current image frame, and to determine a shiftable range and the shift route of the current frame image based on a content of the stress map; and fourth integrated circuitry configured to correct the first image data into second image data when a display of the current frame image is shifted in accordance with the shiftable range and the shift route.

13. The display device of claim 12, wherein the second integrated circuitry is configured to group the pixels into the pixel blocks, calculates the average brightness values, and calculates the brightness distribution of the current frame image.

14. The display device of claim 11, further comprising:

a memory configured to store a second accumulated stress map of a previous frame image.

15. The display device of claim 14, wherein the second integrated circuitry is configured to generate a first accumulated stress map of the current frame image by applying the stress map of the current frame image to the second accumulated stress map of the previous frame image read from the memory.

16. A display device comprising:

at least one processor configured to generate a first image data;

a memory connected to the at least one processor that stores an accumulated stress map;

a display panel connected to the processor and including a plurality of pixels arranged in a plurality of pixel rows and a plurality of pixel columns grouped into pixel blocks, the display panel divided into a first part including some of the pixels and a second part including the first part and the remaining pixels;

wherein the at least one processor is configured to supply the first image data to a display unit of the display device when accumulated brightness values of the pixel blocks are uniformly distributed in the accumulated stress map, and to generate shift information to supply a second image data to distribute pixel stress by shifting display of a current frame image by the pixel blocks when accumulated brightness average values of the pixel blocks are non-uniformly distributed in the accumulated stress map, wherein the at least one processor sets a shiftable range to include coordinates of only the first part when a brightness difference of average brightness values of the pixel blocks of the first accumulated stress map is smaller than a reference brightness difference, and include coordinates of the second part when the brightness difference is greater than the reference brightness difference, wherein the second image data includes a section of the first image data at a first coordinate within the first part shifted by the at least one processor to a second coordinate different from the first coordinate within the shiftable range.

17. The display device according to claim 16, wherein the display panel comprises one of an organic light emitting display panel, a liquid crystal display panel, or a plasma display panel.

18. The display panel of claim 16, wherein the at least one processor includes integrated circuitry that is configured to group the pixel blocks in a matrix structure corresponding to a resolution of the display panel.

19. The display panel of claim 16, wherein the at least one processor includes integrated circuitry configured to calculate a first brightness difference between adjacent pixel rows among pixel blocks, and a second brightness difference between adjacent pixel columns among the pixel blocks.

20. The display panel of claim 16, wherein the at least one processor includes integrated circuitry configured to generate shift stress maps of shifted frame images generated by shifting the current frame images along a plurality of predetermined reference routes within an image display area of the display panel.

* * * * *